US005845787A

United States Patent [19]

Dunnavant, Jr.

[11] Patent Number: 5,845,787

[45] Date of Patent: Dec. 8, 1998

[54] APPARATUS FOR STORING BUNGEE CORDS

[76] Inventor: Berkeley D. Dunnavant, Jr., 115 Declaration Ter., Forest, Va. 24551

[21] Appl. No.: 867,099

[22] Filed: Jun. 2, 1997

[51] Int. Cl.[6] ..... A47F 7/00

[52] U.S. Cl. ..... 211/13.1

[58] Field of Search ..... 211/13.1, 45

[56] References Cited

U.S. PATENT DOCUMENTS

| | | | |
|---|---|---|---|
| 256,412 | 4/1882 | Tinkham | 211/45 |
| 405,955 | 6/1889 | Feineman | 211/45 |
| 3,472,387 | 10/1969 | Olsen | 211/45 |
| 4,948,202 | 8/1990 | Helseth | 211/45 X |
| 5,139,208 | 8/1992 | Schooley | 242/85.1 |
| 5,279,428 | 1/1994 | Lee | 211/13 |

FOREIGN PATENT DOCUMENTS

| | | | |
|---|---|---|---|
| 722067 | 3/1932 | France | 211/45 |
| 3024775 | 1/1982 | Germany | 211/13.1 |

*Primary Examiner*—Blair Johnson
*Attorney, Agent, or Firm*—David Purks

[57] ABSTRACT

A rack for storage of elongated resilient members, such as bungee cords, which have fasteners connected to opposite end regions of the elongated resilient members. The rack has a pair of opposed sides with first and second support members connected to an upper portion of each of the sides and a third support member connected to a lower portion of the sides. The first and second support members are disposed a predetermined distance apart. The first and second support members each have a predetermined width which is sufficient to be releasably engaged by the fasteners of the elongated resilient members. An elongated resilient member can be stored on the rack by engaging one of the fasteners on the first support member, pulling the resilient member around the third support member, and engaging the other fastener to the second support member.

6 Claims, 5 Drawing Sheets

APPARATUS FOR STORING BUNGEE CORDS

FIELD OF THE INVENTION

The present invention relates to an apparatus for storing elongated resilient members, such as bungee cords, which have fasteners attached to each end of the resilient member.

BACKGROUND OF THE INVENTION

Bungee cords are well known devices which generally include a resilient cord, such as a cylindrical or rectangular shaped elastic material, with fasteners attached to each end of the resilient cord. Generally, the fastener is a steel wire which is formed in the shape of a frustoconical spiral spring at one end and a hook at the other end. Alternatively, the fastener is formed in the shape of an "S" with oppositely facing hooks at the ends of the fastener. The hook is U shaped or J shaped so that it can be releasably engaged to a strut, post, or other object. The hooks can further engage each other or along a portion of the resilient cord. In this manner, a plurality of bungees can be connected end-to-end or in other configurations.

The versatility with which the bungees can be interconnected to themselves and other bungees can result in the bungees becoming entangled when they are stored. Such entanglement is particularly troublesome in applications such as commercial trucking where often a 100 bungees are stored in a box in the truck for occasional use to lash down a cover across a load or to secure packages to the truck. Considerable time is spent disentangling stored bungees before they can be used.

SUMMARY OF THE INVENTION

It is an object of the present invention to provide a rack for storing bungee cords in a manner which substantially prevents entanglement of the stored bungee cords.

As another object of the present invention, the rack is adjustable to accommodate bungee cords having a predetermined length while reducing the forces exerted upon the rack by the stored bungee cords.

These and further objects are achieved by a rack for storage of elongated resilient members, such as bungee cords, which have fasteners connected to opposite end regions of the resilient members. In one aspect of the invention, The rack includes a pair of opposed sides with first and second support members which are connected to an upper portion of the sides and a third support member which is connected to a lower portion of the sides. The first and second support members are disposed a predetermined distance apart. The first and second support members each have a predetermined width which is sufficient to be releasably engaged by the fasteners of the resilient members. A resilient member can be stored on the rack by engaging one of the fasteners on the first support member, pulling the resilient member around the third support member, and engaging the other fastener to the second support member.

Further aspects of the invention are described in which the rack is configurable to store resilient members which have substantially different lengths and in which the rack enables more compact storage of bungees along the support members.

BRIEF DESCRIPTION OF THE DRAWINGS

For a more complete understanding of the present invention and the further advantages thereof, reference is now made to the following Detailed Description, taken in conjunction with the Drawings, in which.

DETAILED DESCRIPTION OF THE INVENTION

Figure 1:
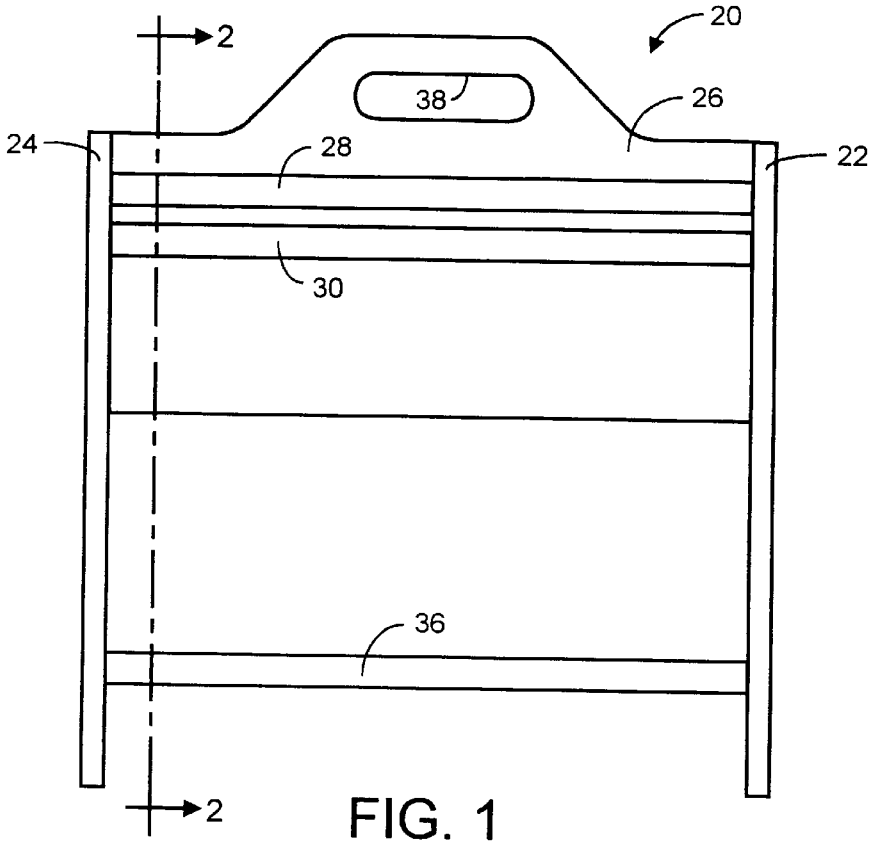
FIG. 1 is a front view of a rack for storing bungee cords according to an embodiment of the present invention.
Figure 2:
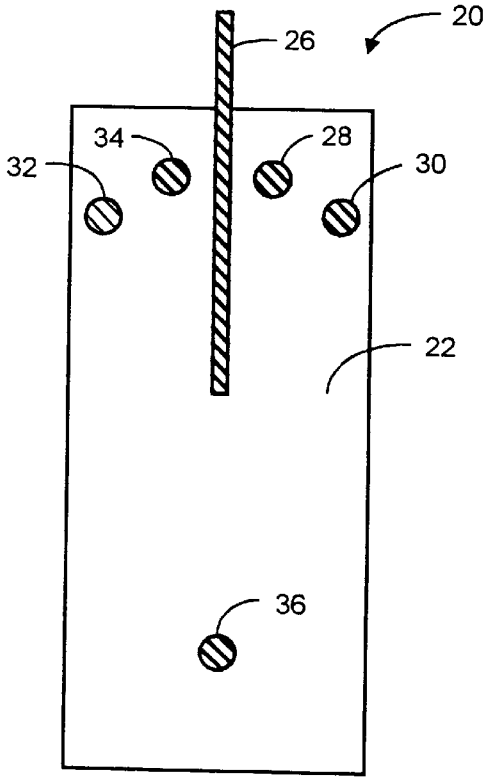
FIG. 2 is an end view along line 2—2 of the rack of FIG. 1.

In accordance with the present invention, a rack 20 for storing bungee cords is shown in FIGS. 1 and 2. The rack 20 includes a pair of sides 22 and 24, a brace 26, two pairs of upper connection members, 28, 30, 32, and 34, and a lower connection member 36. The members, 28–36, and brace 26 are connected between the sides 22 and 24. A handle 38 is defined in the brace 26 which facilitates the portability of the rack 20. The upper members, 28–34, are cylindrical with a predetermined radius, along at least a portion of the members, 28–34, which is sufficient for the hooks of a bungee to releasably engage while providing sufficient strength for storing the bungees. For commonly available bungees, a sufficient radius for the members, 28–36 is generally less than 0.5 inches and, more preferably, about 0.38 inches. The lower member 36 may have a larger radius or different material and/or shape than the upper members 28–34 to support the summed forces of all stored bungees.

Figure 3:
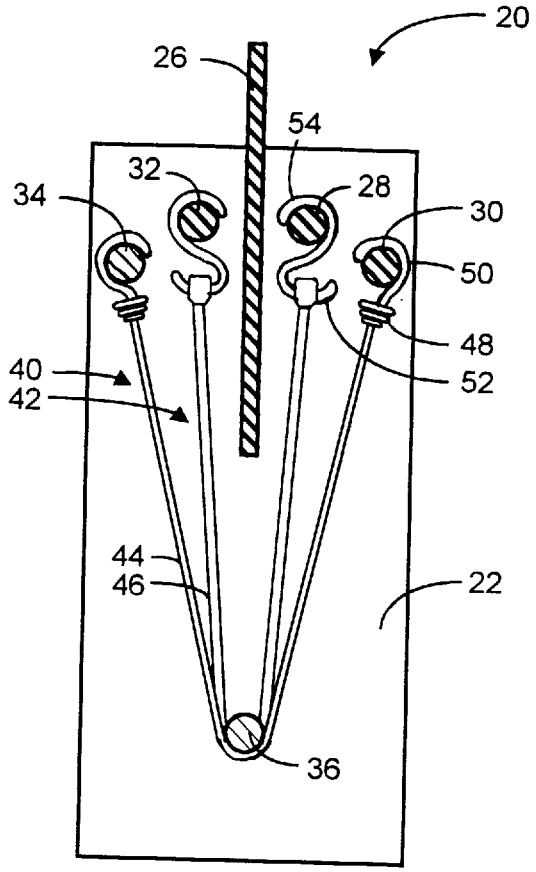
FIG. 3 is the end view of the rack of FIG. 2 and further illustrating two bungees stored thereon.

With reference to FIG. 3, two bungees 40 and 42 are shown stored on the rack 20. The bungees 40 and 42 each include an elongated resilient cord, 44 and 46, respectively, and a fastener at each end of the resilient cords, 44 and 46. The fastener of bungee 40 includes a steel wire which is formed in the shape of a frustoconical spiral spring 48 at one end and a U shaped hook 50 at the other end. The fastener of bungee 42 includes a steel wire which, in contrast to bungee 40, is formed in the shape of an S with oppositely facing U shaped hooks, 52 and 54, at each end.

Each of the bungees, 40 and 42, are stored by engaging one of the fasteners on one of the upper members, 32 or 34, pulling the resilient cord, 44 and 46, around the lower member 36, and engaging the other one of the fasteners to one of the upper members, 28 or 30, which is on the other side of the brace 26.

The upper members, 28–34, are each disposed about the same predetermined distance from the lower member 36 which corresponds to the distance between the hooks of a slightly tensioned bungee. In this manner, stored bungees are retained on the rack 20 while the additive forces which are exerted by the tensioned bungees on the members, 28–36, are minimized. Minimizing the forces which are exerted by stored bungees on the members enables the use of smaller diameter members and/or the use of lower strength materials then could otherwise be used. For bungees which are about 21 inches long, the predetermined distance between each of the upper members, 28–34, and the lower member 36 is about 12.8 inches.

The cylindrical shape of the members, 28–34, enables the hooks, 50 and 54, to readily engage the members, 28–34, while avoiding interference with the resilient cords, 44 and 46, or the lower portions of the fasteners, 48 and 52. Avoiding such interference between the lower portion of the fasteners, 48 and 52, and the members, 28–34, prevents wear on the members, 28–34, that would otherwise occur, enables a user to grasp the lower portion of a fasteners, 48 and 52, to facilitate attaching or removing a bungee on the members, 28–36, more reliably secures an attached bungee on the members, 28–36, and enables more compact storage of bungees along the members, 28–36.

Figure 4:
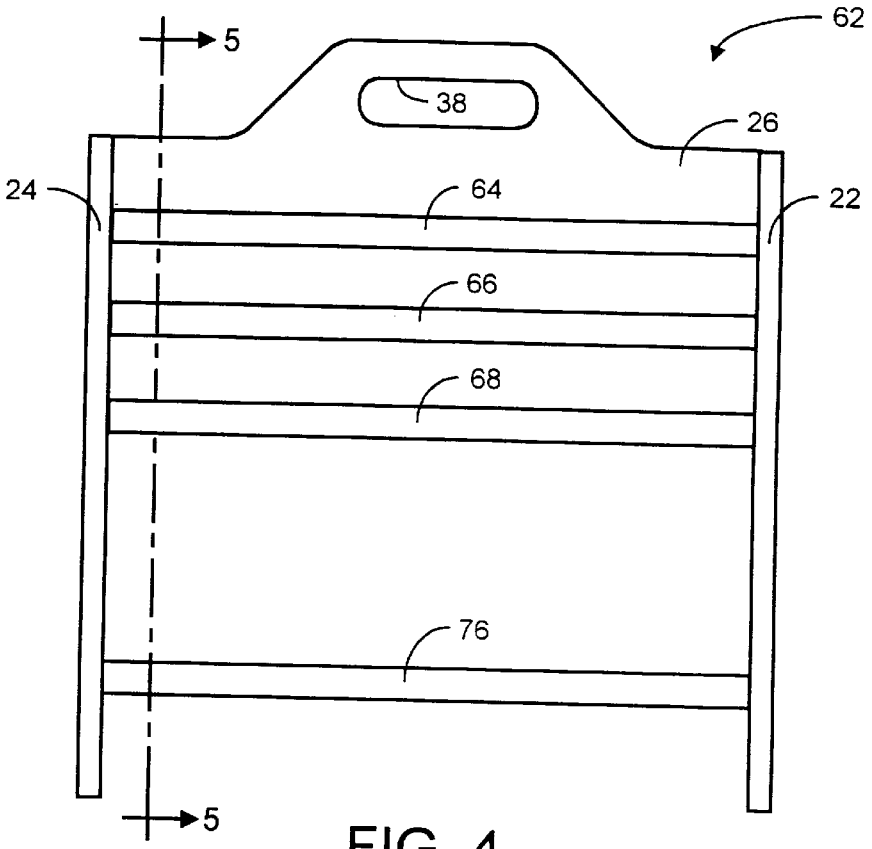
FIG. 4 is a front view similar to FIG. 1, showing another embodiment of a rack for storing bungees.
Figure 5:
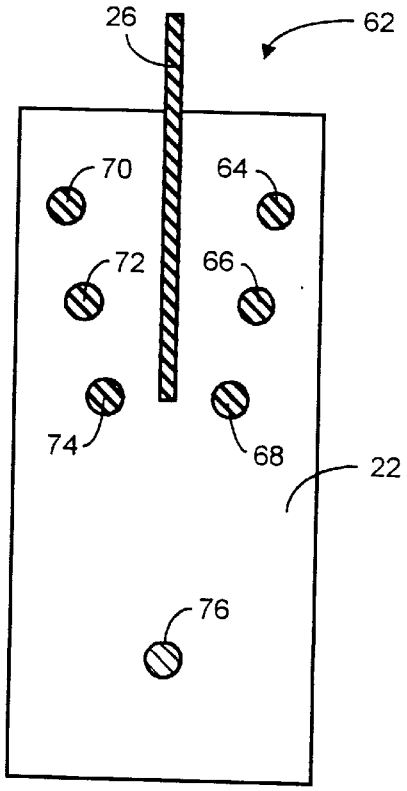
FIG. 5 is an end view along line 5—5 of the rack of FIG. 4.

Another embodiment of a rack 62 is shown in FIGS. 4 and 5. The rack 62 includes the sides, 22 and 24, and the brace 26, as were described with regard to FIGS. 1–3 and similarly numbered. In contrast to FIGS. 1–3, upper members, 64–74, are disposed at three predetermined distances from a lower member 76 which correspond to the distances between the hooks of three different length slightly tensioned bungees. In this manner, bungees having three substantially different lengths can be securely stored on the rack 62 while avoiding the additive forces which would otherwise be exerted by the bungees on the rack 62 if shorter bungees were stretched to engage upper members which are disposed at distances from the lower member which are appropriate for the longest bungee.

The upper members, 64–68 and 70–74, are aligned along axes which extend between the lower member 76 and the upper members 64 and 70, respectively. Such alignment avoids interference between the resilient cords of the bungees and the upper members and, thereby, facilitates a user's attachment and removal of bungees on the rack 62 and minimizes the forces exerted by stored bungees on the rack 62.

Figure 6:
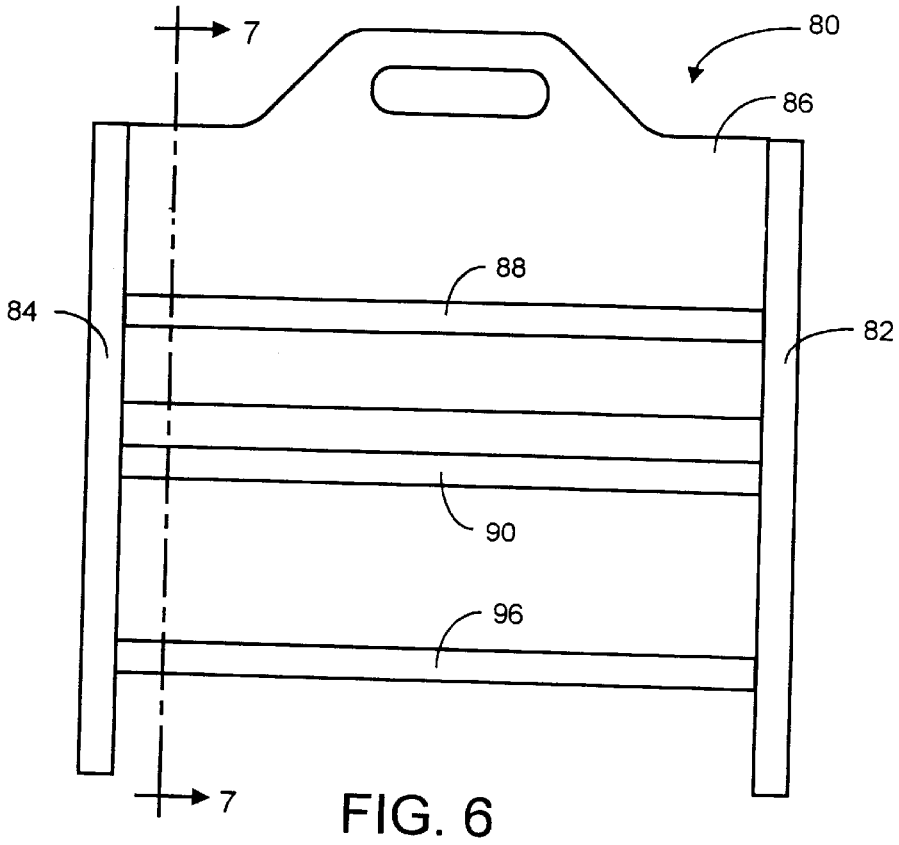
FIG. 6 is a front view similar to FIG. 1, showing another embodiment of a rack for storing bungees.
Figure 7:
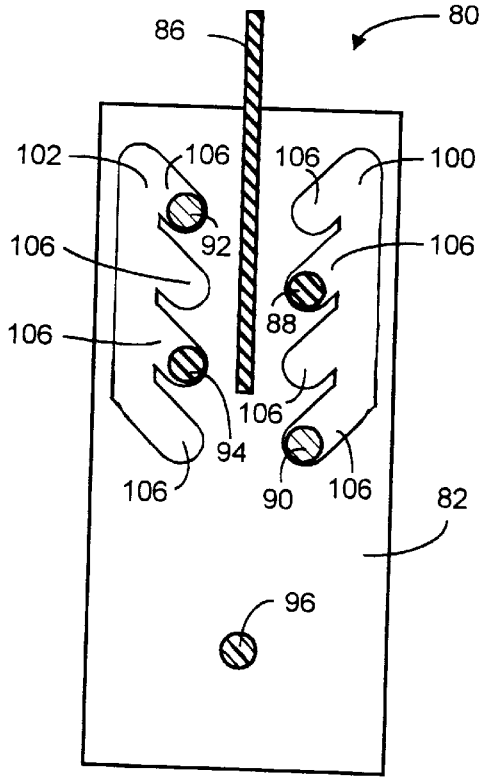
FIG. 7 is an end view along line 7—7 of the rack of FIG. 6.

Another embodiment of a rack 80 is shown in FIGS. 6 and 7. The rack 80 includes sides, 82 and 84, a brace 86, upper connection members, 88–94, and a lower connection member 96. Channels, 100 and 102, are defined within each of the sides, 82 and 84, and include four end channel regions 106 which extend downward toward the lower member 96. The ends of the upper members, 88–94, are disposed within the end channel regions 106. The channels 100 and 102 have a width which is larger than the diameter of the upper members 88–94 so that a user can move the upper members 88–94 within the channels 100 and 102 between different end channel regions 106. The upper members 88–94 are retained within the end channel regions 106 by gravitational forces and the downward forces exerted by stored bungees on the upper members 88–94.

A user can move the upper members 88–94 between the end channel regions 106 through the channels 100 and 102 to provide an arrangement in which the distances between the upper members 88–94 and the lower member 96 correspond to the distances between the hooks of different length slightly tensioned bungees. In this manner, the rack 80 is configurable to accommodate different length bungees.

Figure 8:
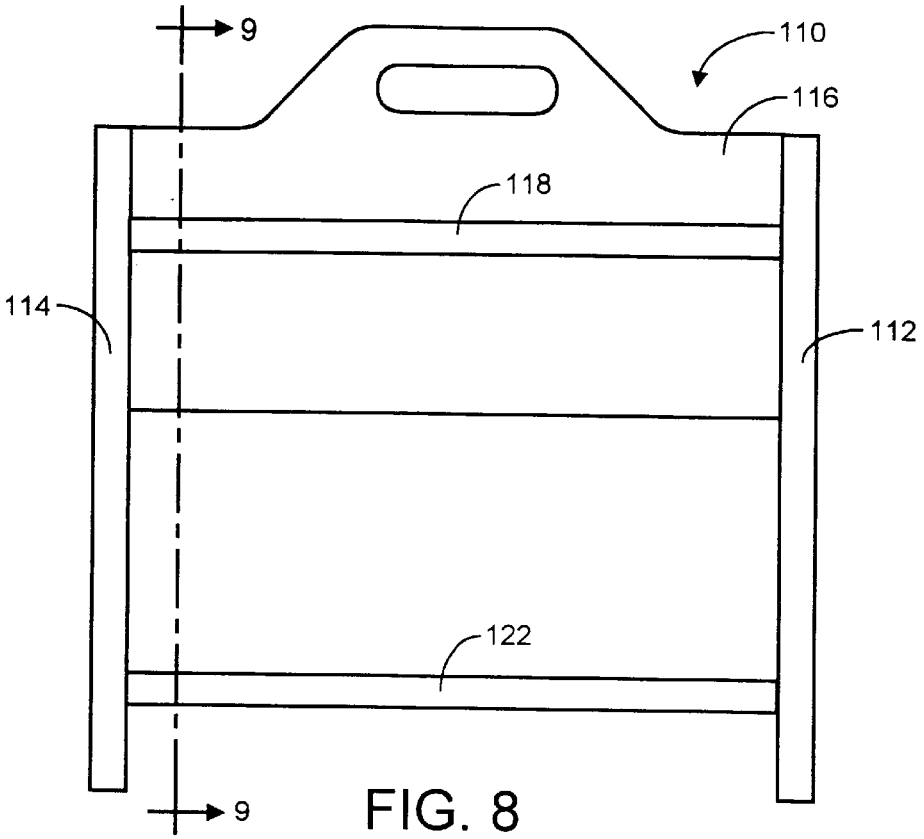
FIG. 8 is a front view similar to FIG. 1, showing another embodiment of a rack for storing bungees.
Figure 9:
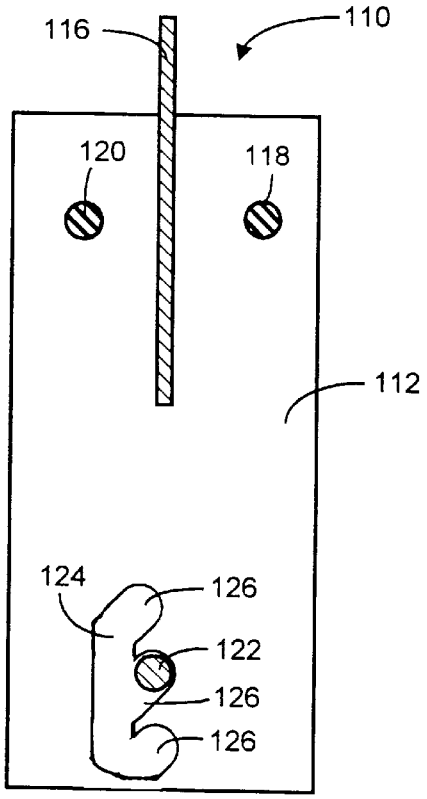
FIG. 9 is an end view along line 9—9 of the rack of FIG. 8.

Another embodiment of a rack 110 is shown in FIGS. 8 and 9. The rack 110 includes sides, 112 and 114, a brace 116, upper connection members, 118 and 120, and a lower connection member 122. Channels 124 are defined within the lower portion of each of the sides, 112 and 114, which include three end channel regions 126. The end channel regions 126 extend upward toward the upper members 118 and 120. The ends of the lower member 122 are disposed within the end channel regions 126. The channels 124 have a width which is larger than the diameter of the lower member 122 so that a user can move the lower member 122 within the channels 124. The lower member 122 is retained within the end channel regions 126 by the upward forces exerted by stored bungees on the lower member 122.

A user can move the lower member 122 between the end channel regions 126 through the channels 124 to provide an arrangement in which the distance between the upper members, 118 and 120, and the lower member 122 corresponds to the distance between the hooks of slightly tensioned bungees which are to be stored on the rack 110. In this manner, the rack 110 is configurable to accommodate different length bungees through the movement of the single lower member 122.

While the invention has been described in connection with several embodiments, it is to be understood that the invention is not to be limited to the disclosed embodiments, but to the contrary, is intended to cover various modifications and equivalent arrangements included within the spirit and scope of the appended claims.

What is claimed is:

1. A rack for storage of elongated resilient members which have fasteners connected to opposite end regions of the elongated resilient members, the rack comprising:

a pair of opposing spaced sides, each of the sides having an upper portion and a lower portion;

first and second support members disposed a predetermined distance apart and connected to the upper portion of each of the pair of opposed sides and extending there between, wherein the first and second support members each have a predetermined thickness, along a portion of the length of the first and second support members, which is adapted to be releasably engaged by the fasteners of the elongated resilient members; and a third support member connected to the lower portion of each of the pair of opposed sides and extending therebetween and disposed about the same distance from the first and second members each of the pair of opposed sides defines an elongate channel, in the upper portion of each of the pair of opposed sides, which is adapted to receive the first and second support members, the cannel defined in each of the pair of opposed sides includes a plurality of end channel regions extending from the axis of said channel at an angle and which extend toward the third support member whereby said third support member is adjustably mounted within respective opposing end channel regions.

2. A rack for storage of elongated resilient members which have fasteners connected to opposite end regions of the elongated resilient members, the rack comprising:

a pair of opposing spaced sides, each of the sides having an upper portion and a lower portion;

first and second support members disposed a predetermined distance apart and connected to the upper portion of each of the pair of opposed sides and extending therebetween, wherein the first and second support members each have a predetermined thickness, along a portion of the length of the first and second support members, which is adapted to be releasably engaged by the fasteners of the elongated resilient members; and a third support member connected to the lower portion of each of the pair of opposed sides and extending therebetween, wherein each of the pair of opposed sides defines an elongate channel, in the lower portion of each of the pair of opposed sides, which is adapted to receive the third support member, each channel including a plurality of end channel regions extending from the axis of said channel at an angle and which extend toward the first and second support members whereby said third support member is adjustably mounted within respective opposing end channel regions.

3. The rack according to claim 2, wherein:

the first and second support members are substantially cylindrical.

4. The rack according to claim 2, wherein:

each of the pair of opposed sides defines a channel, in the upper portion of each of the pair of opposed sides, which is adapted to receive the first support member.

5. The rack according to claim 4, wherein:

the channel defined in each of the pair of opposed sides includes a plurality of end channel regions which extend toward the second support member.

6. A rack for storage of elongated resilient members which have fasteners connected to opposite end regions of the elongated resilient members, the rack comprising:

a pair of opposing, spaced sides, each of the sides having an upper portion and a lower portion;

first and second cylindrical members disposed a predetermined distance apart and connected to the upper portion of the pair of opposed sides and extending therebetween, wherein the radius of the first and second support members, along at least a portion of the first and second cylindrical members, is selected to be releasably engaged by the fasteners of the elongated resilient members;

a third cylindrical member connected to the lower portion of the pair of opposed sides and extending therebetween and disposed about the same predetermined distance from the first and second members, wherein each of the pair of opposed sides defines an elongate channel, in the lower portion of each of the pair of opposed sides, which is adapted to receive the third cylindrical member, each channel including a plurality of end channel regions extending from the axis of said channel at an angle and which extend toward the first and second cylindrical members, whereby said third support member is adjustably mounted within respective opposing end channel regions.

* * * * *